United States Patent [19]

Latta et al.

[11] 4,104,443

[45] Aug. 1, 1978

[54] ANTISTATIC FINISH FOR TEXTILES MATERIAL

[75] Inventors: Bruce M. Latta, Wayne; Catherine V. Stevens, Closter; Bruce E. Dennis, Clifton, all of N.J.

[73] Assignee: J. P. Stevens & Co., Inc., New York, N.Y.

[21] Appl. No.: 794,575

[22] Filed: May 6, 1977

[51] Int. Cl.[2] ..... B44D 1/22

[52] U.S. Cl. ..... 428/474; 427/385 B; 427/390 B; 428/480; 428/524

[58] Field of Search ..... 427/385 B, 390 B; 428/474, 480, 524

[56] References Cited

U.S. PATENT DOCUMENTS

| | | | |
|---|---|---|---|
| 2,897,170 | 7/1959 | Gruber | 428/375 X |
| 3,380,850 | 4/1968 | Jones et al. | 427/390 B |
| 3,467,487 | 9/1969 | Kirschnek et al. | 427/390 X |
| 3,552,908 | 1/1971 | Drum | 8/115.6 |
| 3,595,813 | 7/1971 | Hartgrove | 260/849 X |
| 3,794,597 | 7/1973 | Hartgrove | 427/390 X |
| 3,925,462 | 12/1975 | Graff | 8/115.5 X |

*Primary Examiner*—Michael R. Lusignan

*Attorney, Agent, or Firm*—Michael T. Frimer; Charles Stein

[57] ABSTRACT

Durable antistatic properties are imparted to fabrics of synthetic polymers such as nylon and polyester by forming on said fabric a water insoluble reaction product of a melamine formaldehyde resin with certain ethoxylated quaternary ammonium salts and amine compounds. A urea formaldehyde resin can optionally be included as a third component of the reaction product. In a preferred embodiment, the fabric having the reaction product thereon is washed with a solution containing an anionic surfactant.

10 Claims, No Drawings

ANTISTATIC FINISH FOR TEXTILES MATERIAL

FIELD OF THE INVENTION

This invention relates to imparting durable antistatic properties to fabrics of synthetic polymeric material.

BACKGROUND OF THE INVENTION

It is known to apply certain nitrogenous compounds on textiles as antistatic agents. In U.S. Pat. No. 2,897,170 of Gruber, there is disclosed for this purpose the use of quaternary ammonium salts having polyoxyalkylene side chains. However, the system of U.S. Pat. No. 2,897,170 is not wash durable and the treated product does not possess satisfactory antistatic properties after repeated washings. In U.S. Pat. No. 3,925,462 of Graff, there is disclosed a wash durable antistatic agent utilizing quaternary ammonium salts having polyoxyalkylene side chains. However, the system is quite complex and involves reaction of the quaternary salts with an aromatic polyisocyanate and a thermally reversible blocking agent prior to application to the fabric, as well as a heat-curing step of the treated fabric.

In U.S. Pat. Nos. 3,595,813 and 3,749,597 of Hartgrove, there are disclosed wash durable antistatic finishes obtained by reacting a crosslinking agent such as a melamine formaldehyde derivative with certain nitrogen-containing polyoxyalkylene materials. The preferred polyoxyalkylene materials are polymers having recurring units of the formula:

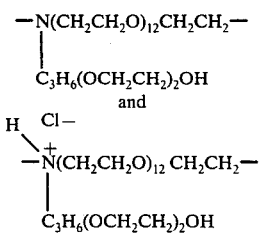

(PHPA)

and (PHPA hydrochloride)

While this finish is satisfactory for many uses, it can cause significant yellowing of white fabrics and discoloring of light colored fabrics. Additionally, this finish has an adverse effect on the tactile aesthetics, such as hand, of some types of fabric, particularly lightweight tricot fabrics.

The problem of fabric discoloration is due, at least in part, to the presence of nitrogen in the antistatic component of the finish, which, upon exposure to atmospheric oxygen, pollutants in the air, and other various chemicals, can chemically react to form highly colored products. Moreover, the antistatic properties of such a finish are proportional to the amount of nitrogen present. In order to assure that satisfactory antistatic properties will be obtained on the substrate fabric after multiple launderings, a considerable excess of the antistatic component must be applied to the fabric initially, since much of the finish is lost in laundering or in wear. The high add-ons required to achieve satisfactory durable antistatic properties have an adverse effect on fabric hand, and also intensify the problem of fabric discoloration.

SUMMARY OF THE INVENTION

In accordance with the present invention, a wash durable antistatic finish is imparted to a synthetic polymer fabric by applying to the fabric a melamine derivative (prepared by reacting melamine with either formaldehyde or formaldehyde and an alkanol) and certain ethoxylated quaternary salts or amine compounds having at least 2 polyoxyalkylene substituents on the nitrogen atom in which the terminal group contains labile hydrogen and is separated from the nitrogen by at least 14 intervening atoms. The fabric is then heated to cause the melamine derivative and ethoxylated compound to coreact and form an insoluble product.

Preferably a nonionic surfactant is applied along with the melamine derivative and ethoxylated compound. Additionally, the colorfastness of the finished fabric can be improved by subjecting the fabric, after formation of the insoluble product thereon, to a washing treatment with an aqueous solution of an anionic surfactant. Using the procedure of the present invention, an antistatic finish can be obtained which has good resistance to discoloration and will withstand repeated washings, and which does not require such high add-ons as to result in substantial adverse effects on the fabric hand.

DETAILED DESCRIPTION OF THE INVENTION

The present invention provides a method of imparting antistatic properties to fabrics made of synthetic polymers by applying thereto an aqueous composition containing an ethoxylated nitrogenous compound and a melamine derivative. The fabric is then heated to coreact the applied compounds and form an insoluble product.

The ethoxylated compounds which can be used in the present invention are quaternary ammonium salts having the formula:

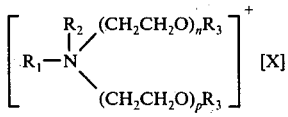

wherein $R_1$ is an alkyl group of 8 to 22 carbon atoms;

$R_2$ is an alkyl group of 1 to 22 carbon atoms or $-(CH_2CH_2O)_rR_4$;

$R_3$ is hydrogen, $-CH_2CH_2NH_2$ or $-CH_2CH_2SH$;

$R_4$ is hydrogen, $-CH_2CH_2NH_2$, $-CH_2CH_2SH$ or an alkyl group of 1 to 4 carbon atoms;

n, p and r are integers of from 5 to 60, and $X^-$ is an anion and amine compounds of the formula

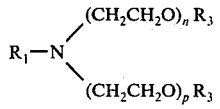

wherein $R_1$, and $R_3$ and n and p have the meanings given above.

Specific examples of some of the suitable compounds are:

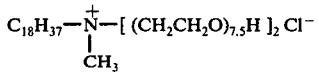

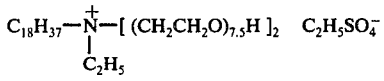

$C_{18}H_{37}$—N—[$(CH_2CH_2O)_{7.5}$ H]$_2$
and
$C_{18}H_{37}$—N—[$(CH_2CH_2O)_{25}$ H]$_2$ The melamine derivative is an N-methylol derivative of melamine having from 2 to 6 methylol groups or a lower alkyl ether derived from such an N-methylol compound wherein the sum of —$CH_2OH$ groups and —$CH_2OX$ groups is from 2 to 6 with X being a lower alkyl group of 1 to 4 carbon atoms and preferably being methyl. The melamine derivative is thus defined by the formula

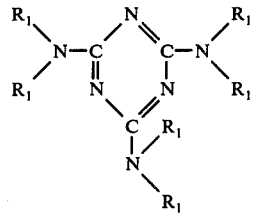

where $R_1$ at each occurrence is independently hydrogen or —$CH_2OZ$ with Z being hydrogen or alkyl of 1 to 4 carbon atoms and with at least two of said $R_1$ groups being —$CH_2OZ$. The N-methylol compounds (wherein Z is always hydrogen) can be prepared by reacting melamine with 2 or more moles of formaldehyde according to known procedures. The lower alkyl ethers can be prepared by known procedures such as by reacting the N-methylol compounds with an alkanol or co-reacting melamine, formaldehyde and alkanol, said alkanol containing 1 to 4 carbon atoms and preferably being methanol. If desired, mixtures of the above-described melamine derivatives can be used.

In addition to the melamine derivative the system which serves to crosslink the ethoxylated compound can also include a urea formaldehyde resin such as (1) Dimethyloldihydroxyethyleneurea (DMDHEU)

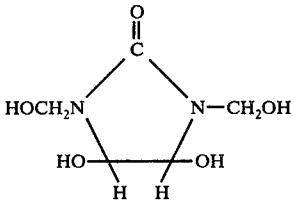

(2) Dimethylolethyleneurea (DMEU)

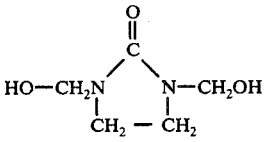

and (3) Urons

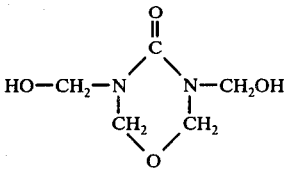

The amount of ethoxylated compound applied to the fabric should be equal to at least 1% by weight based on the weight of the fabric. Preferably, the amount of ethoxylated compound should not exceed 5% by weight of the fabric in order to prevent undue stiffening of the fabric. Sufficient melamine derivative and urea formaldehyde resin should be used to crosslink all of the ethoxylated compounds.

The reaction between the ethoxylated compound and the melamine derivative is preferably catalyzed by means of an acid, an acid forming salt or a mixture of acid and salt. Carboxylic acids such as citric acid and oxalic acid and mineral acids such as hydrochloric acid in dilute concentrations can be used. Alternately, acidic metallic salts such as zinc nitrate and magnesium chloride can be used by themselves or in conjunction with the acid. No particular quantity of acid need be employed as long as the pH of the system is below 6, preferably between about 2.0 and 5.5.

The reactants and the catalyst are applied in an aqueous bath which can also contain other additives such as wetting agents, organic solvents, softeners, optical brighteners, defoamers and the like. In particular, it has been found that improved antistatic properties can be obtained if the bath contains a nonionic surfactant such as nonylphenoxypoly (ethyleneoxy) ethanol, preferably in an amount such that the quantity applied to the fabric is equal to about 0.2 to 3% based on the weight of the fabric. If desired, a small amount of an alkanol such as methanol can be added to assist in dissolving the ethoxylated compound. The aqueous bath can be applied to the fabric by padding, spraying or other conventional means for applying such treating baths to fabric. The treated fabric is then dried and heated to a temperature which is sufficiently high to effect reaction between the ethoxylated compound and the crosslinking system, preferably the curing temperature is from about 120 to 250° C.

It has been found that the colorfastness of the treated fabrics, including resistance to yellowing due to contact with sulfur-containing materials such as rubber, can be improved by washing the fabric, after curing of the antistatic finish thereon, with a solution of an anionic surfactant such as sodium lauryl sulfate. Such treatment with an anionic surfactant does not impair the antistatic properties of the treated fabric. Washing the treated fabric with water alone does not improve the colorfastness.

The term synthetic polymer fabric refers to fabric made of synthetic thermoplastics and blends of such materials with natural textile materials such as cotton and wool. Illustrative of suitable synthetic polymer fabrics are fabrics made of polyesters, polyamides, acrylics, vinyls, polyethylene and polypropylene and blends of these polymers with cellulosic materials and wool.

The following examples are given to further illustrate the invention. Preceding the examples is a description of the test methods used in evaluating the antistatic finishes.

EVALUATION TEST METHODS

Specific area resistivity — (SAR) — Run at 25% relative humidity and 70° F. following procedure of AATCC Test Method 76-1975. Results are given in ohms per square.

Laundering — Machine washed at 120° F. following procedure of AATCC Test Method 124-1973 tumble drying only after the final laundering.

Lightfastness — Measured according to AATCC Test Method 16A-1974 after 20 hours exposure to a standard fadeometer unit of light.

Washfastness — Test IIA of AATCC Test Method 61-1972. The evaluation for staining was run using acetate (A), cotton (C), nylon (N), polyester (P), Orlon® (O) and wool (W). If none of the fibers stained, the results are reported in the examples as a "5", otherwise the results are reported only for those fibers having a value of less than "5".

Colorfastness to Ozone — AATCC Test Method 109-1975.

Colorfastness to Burnt Gas Fumes — AATCC Test Method 23-1975.

Sulfur Band Yellowing — A swatch of fabric was fitted over the mouth of a beaker and double wrapped with high sulfur content rubber bands. The fabric was left under ambient conditions for 5 days and then the rubber bands were removed. The area of the fabric which had been in contact with the rubber was rated for discoloration using the Gray Scale for color change (5=no discoloration; 1= severe discoloration).

Colorfastness to Crocking — AATCC Method 8-1972.

EXAMPLE 1

The fabric treated in this example was made of a polyamide having recurring units of the formula

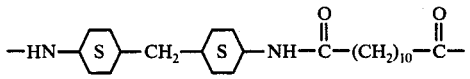

A treating bath was prepared as follows:

Component A was made by dissolving a quaternary ammonium salt of the formula

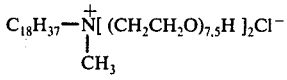

in an equal weight of methanol

Component B was made by admixing the crosslinking agent hexakis (methoxymethyl)melamine (HMM) with an equal weight of the nonionic surfactant Igepal C0730 [nonylphenoxy poly(ethyleneoxy) ethanol]. Quantities of Components A and B were combined and dissolved in water so as to give a treatment bath which contained 2 parts by weight of both the quaternary ammonium salt and methanol and 1 part by weight of the crosslinking agent and the surfactant per 100 parts of bath. The pH of the bath was adjusted to 2.5 by the addition of oxalic acid.

The treatment bath was padded onto the fabric so as to give a wet pickup of 100%. The fabric was dried at 100° C. and then heated at 175° C. until a insoluble film was formed on the fabric. The specific area resistivity (SAR) of the fabric was then determined. The results are given in Table 1.

COMPARATIVE EXAMPLES

A series of comparative examples A, B, C and D were run with the bath compositions shown in Table 1, using a wet pickup of 100% and the same fabric and procedures as described in Example 1. The bath of Example A corresponded to Sample 23 of the Hartgrove patents. In Example B the bath of Example A was modified by replacing the crosslinking system with the system used in Example 1. In Example C the quaternary ammonium salt of Example 1 was replaced with an equal weight of PHPA. In Example D the quaternary ammonium salt of Example 1 was replaced with an amount of PHPA containing an equivalent amount of nitrogen.

TABLE 1

| Ex. | Ammonium Salt | PHPA | $CH_3OH$ | HMM | DMEU | Aerotex M-3 | Surfactant | $MgCl_2$ | HCl | Oxalic Acid | SAR at 25% RH Original | SAR at 25% RH after 35 washes |
|---|---|---|---|---|---|---|---|---|---|---|---|---|
| 1 | 2.0 | — | 2.0 | 1.0 | — | — | 1.0 | — | — | pH 2.5 | (L) $8.0 \times 10^{10}$<br>(W) $9.9 \times 10^{13}$ | $3.5 \times 10^{13}$<br>$2.0 \times 10^{13}$ |
| A | — | 6.4 | — | — | 1.0 | 0.5 | — | 0.7 | pH5 | — | (L) $6.1 \times 10^{9}$<br>(W) $1.1 \times 10^{10}$ | $2.5 \times 10^{14}$ $\rightarrow 10^{15}$<br>$>10^{15}$ |
| B | — | 6.4 | 2.0 | 1.0 | — | — | — | — | — | pH 2.5 | (L) $2.8 \times 10^{11}$<br>(W) $3.9 \times 10^{11}$ | $2.2 \times 10^{13}$<br>$>10^{15}$ |
| C | — | 2.0 | 2.0 | 1.0 | — | — | 1.0 | — | — | pH 2.5 | (L) $8.4 \times 10^{11}$<br>(W) $5.0 \times 10^{11}$ | $1.5 \times 10^{14}$<br>$2.7 \times 10^{14}$ |
| D | — | 1.5 | 2.0 | 1.0 | — | — | — | — | — | pH 2.5 | (L) $1.1 \times 10^{14}$<br>(W) $9.8 \times 10^{13}$ | $>10^{15}$<br>$>10^{15}$ |

EXAMPLE 2

Samples of tricot fabric made from the polyamide described in Example 1 were disperse dyed amber and then treated with an antistatic agent in accordance with the procedure of Example 1. Fabric samples were then afterwashed at 120° F. for 5 minutes using 0.5 gm./liter of the following anionic surfactants:

(1) sodium lauryl sulfate (SLS) - Maprofix 563.

(2) sulfonated aliphatic polyester (SP) - Nekal WS-25.

Additionally tests were run with an antistatic finished control which was water washed as described above without the addition of an anionic surfactant and a sample of the dyed fabric to which no antistatic finish was applied. The results of tests for lightfastness, washfastness, crocking and electrical resistivity are given in Table 2.

TABLE 2

| | SLS | SP | Control | Unfinished |
|---|---|---|---|---|
| Lightfastness | 3 | 2/3 | 1/2 | 3 |
| Washfastness | | | | |
| Color change | 4 | 3/4 | 3 | 4/5 |
| Staining | A-4/5,N-2 | A-4,N-1 | A-3,N-1 | A-4/5,N-4 |
| Crocking | | | | |
| Dry | 4/5 | 5 | 4/5 | 5 |
| Wet | 4/5 | 4/5 | 4 | 5 |
| Electrical Resistivity Original, SAR | | | | |
| Length | $1.2 \times 10^{13}$ | $6.6 \times 10^{12}$ | $1.0 \times 10^{13}$ | $>10^{15}$ |
| Width | $3.7 \times 10^{12}$ | $2.8 \times 10^{12}$ | $3.3 \times 10^{12}$ | $>10^{15}$ |

EXAMPLE 3

A sample of white tricot fabric made from the polyamide described in Example 1 was subjected to the same antistatic treatment and afterwash with sodium lauryl sulfate as used in Example 2. This fabric, along with a sample which was afterwashed without the addition of an anionic surfactant, were tested for yellowing and electrical resistivity. The results are given in Table 3.

TABLE 3

| | SLS afterwashed | Water afterwashed |
|---|---|---|
| Yellowing, sulfur bands | 5 | 1 |
| Electrical resistivity | | |
| SAR-original | | |
| length | $2.9 \times 10^{12}$ | $3.1 \times 10^{11}$ |
| width | $9.3 \times 10^{11}$ | $1.5 \times 10^{11}$ |
| SAR-35 washes | | |
| length | $6.3 \times 10^{13}$ | $8.5 \times 10^{13}$ |
| width | $4.7 \times 10^{13}$ | $5.3 \times 10^{13}$ |

EXAMPLE 4

The procedure of Example 2 was repeated except that the fabric was dyed with a series of different disperse dyes. Samples of the fabric afterwashed with sodium lauryl sulfate were tested for lightfastness and washfastness, along with treated samples which had not been afterwashed and samples which had been dyed only. The results are given in Table 4.

TABLE 4

| | SLS afterwashed | Treated only | Dyed only |
|---|---|---|---|
| Foron Blue S-BGL (0.5%) | | | |
| lightfastness-20SFU | 2/3 | 1/2 | 5 |
| washfastness-IIA wash | | | |
| color change | 2 | 2/3 | 4/5 |
| staining | A-2,N-1/2 | A-2,N-1 | N-4 |
| Latyl Yellow GFSW (2.0%) | | | |
| lightfastness | 4/5 | 1/2 | 5 |
| washfastness-color change | 2/3 | 2/3 | 5 |
| staining | 5 | A-4,N-4 | 5 |
| Terasil Brown 3R (2.0%) | | | |
| lightfastness | 2/3 | 1 | 3/4 |
| washfastness-color change | 2/3 | 2/3 | 5 |
| staining | N-3 | N-1 | 5 |
| Intrasil Scarlet 2GH(1.0%) | | | |
| lightfastness | 2/3 | 1 | 2/3 |
| washfastness-color change | 3 | 1 | 5 |
| staining | A-3,N-3 | A-1,N-1 | 5 |
| Intrasil Blue R(2.0%) | | | |
| lightfastness | 4 | 1 | 5 |
| washfastness-color change | 2 | 2 | 4 |
| staining | A-1/2,N-1 | A-1,N-1 | A-1,N-1 |

EXAMPLE 5

Samples of a nylon 6 tricot fabric and a polyester/nylon (60/40) tricot fabric were padded (85% wet pickup) with a treatment bath consisting of 4 grams of the quaternary ammonium salt of Example 1
4 grams of methanol
2 grams of hexakis (methoxymethyl)melamine
2 grams of Igepal C0730
4 grams of polyethylene softener
200 cc of water
oxalic acid to pH 2.5

The fabrics were dried at 300° F. for 1 minute and cured at 340° F. for 30 seconds. The specific area resistivity was as follows:

| | Nylon 6 | Polyester/Nylon |
|---|---|---|
| Original - length | $2.1 \times 10^{11}$ | $4.0 \times 10^{11}$ |
| width | $5.0 \times 10^{11}$ | $0.7 \times 10^{11}$ |
| After 35 launderings | | |
| length | $0.5 \times 10^{13}$ | $8.0 \times 10^{11}$ |
| width | $1.0 \times 10^{13}$ | $2.0 \times 10^{11}$ |

EXAMPLE 6

A polyester tricot fabric was padded (100% wet pickup) with an aqueous bath containing:

1.5% of the quaternary ammonium salt of Example 1
1.5% methanol
1.0% hexakis (methoxymethyl)melamine
1.0% nonionic surfactant (Tergitol 155-9, nonylphenoxy poly(ethyleneoxy)$_{9-10}$ ethanol)
2.5% polyethylene softener oxalic acid to pH 2.5

The fabric was dried and cured for 40 seconds at 350°-360° F. The fabric was then washed with water and dried. The properties of the fabric were as follows:

| | Specific Area Resistivity |
|---|---|
| Original - length | $1.2 \times 10^{12}$ |
| width | $4.8 \times 10^{11}$ |
| 35 launderings | |
| length | $2.2 \times 10^{13}$ |
| width | $1.5 \times 10^{13}$ |
| Sulfur band yellowing | 1 |
| Lightfastness 20 SFU | 5 |
| Ozone - 2 cycles | 5 |
| Burnt gas fumes - 2 cycles | 4 (yel.) |

A sample of the above finished fabric was afterwashed in the laboratory with a 0.5% sodium lauryl sulfate solution for 5 minutes at 120° F., rinsed and dried, and then retested for sulfur band yellowing. None was found.

EXAMPLE 7

The following formulations were applied by padding to undyed tricot fabric made of the polyamide of Example 1. The samples were dried for 1 minute at 300° F. and cured for 45 seconds at 360° F. All the pad baths were adjusted to pH 2.5 with oxalic acid and the wet pickup was 100%.

TABLE FOR EXAMPLE 7

| | Ethoxylated Component | | | |
|---|---|---|---|---|
| | Quaternary Ammonium Salt | | Amine A | Amine B |
| % Ethoxylated Component | 2.0 | 1.5 | 1.5 | 2.0 |
| % Hexakis (methoxymethyl)melamine | 1.0 | 1.0 | 1.1 | 1.0 |
| % Igepal C0730 | 1.0 | 1.0 | 1.0 | 1.0 |
| % JPS 324 (emulsion of reactive silicon polymer) | 1.25 | 1.25 | 1.0 | 1.25 |
| SAR | | | | |
| Original - length | $4.4 \times 10^{10}$ | $1.0 \times 10^{11}$ | $3.3 \times 10^{12}$ | $1.3 \times 10^{11}$ |
| width | $2.9 \times 10^{10}$ | $7.3 \times 10^{11}$ | $2.5 \times 10^{12}$ | $2.6 \times 10^{11}$ |
| 35 Launderings | | | | |
| length | $2.5 \times 10^{12}$ | $1.7 \times 10^{13}$ | $2.7 \times 10^{13}$ | $7.8 \times 10^{13}$ |
| width | $1.3 \times 10^{12}$ | $6.2 \times 10^{12}$ | $1.9 \times 10^{13}$ | $2.4 \times 10^{13}$ |

ETHOXYLATED COMPOUNDS

Quaternary Ammonium Salt — Compound of the formula

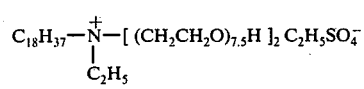

Amine A — Compound of the formula

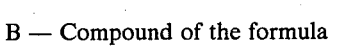

Amine B — Compound of the formula

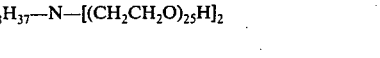

EXAMPLE 8

Tricot fabric of the polyamide of Example 1 was dyed with 0.1% (based on the weight of the fabric) Latyl Yellow GFSW, and was then treated with an antistatic finish bath equivalent to that given in Example 7 with 2.0% quaternary ammonium salt. Part of the fabric was not afterwashed, and part was afterwashed with 0.5% sodium lauryl sulfate solution at 120° F. for 5 minutes, and then rinsed. The results were as follows:

| Specific Area Resistivity | Not Afterwashed | Afterwashed |
|---|---|---|
| Original | | |
| length | $1.1 \times 10^{10}$ | $7.8 \times 10^{10}$ |
| width | $1.1 \times 10^{10}$ | $7.3 \times 10^{10}$ |
| After 35 launderings | | |
| length | $3.3 \times 10^{12}$ | $2.1 \times 10^{13}$ |
| width | $2.5 \times 10^{12}$ | $1.8 \times 10^{13}$ |
| Colorfastness to: | | |
| Washing (Test IIA - 120° F.) | | |
| color change | 3 | 3/4 |
| staining | 5 | 5 |
| Lightfastness | 3/4 | 5 |

It will be apparent that many modifications and variations may be effected without departing from the scope of the novel concepts of the present invention, and the illustrative details disclosed are not to be construed as imposing undue limitations on the invention.

We claim:

1. A process of imparting durable antistatic properties to synthetic polymer fabric which comprises applying to said fabric an aqueous composition containing (A) an ethoxylated compound selected from the group consisting of compounds having the formula

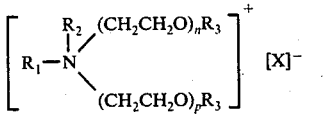

-continued and

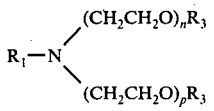

wherein $R_1$ is an alkyl group of 8 to 22 carbon atoms;

$R_2$ is an alkyl group of 1 to 22 carbon atoms or $-(CH_2CH_2O)_rR_4$;

$R_3$ is hydrogen, $-CH_2CH_2NH_2$ or $-CH_2CH_2SH$;

$R_4$ is hydrogen, $-CH_2CH_2NH_2$, $-CH_2CH_2SH$ or an alkyl group of 1 to 4 carbon atoms;

n, p and r are integers of from 5 to 60, and $X^-$ is an anion and (B) A melamine derivative of the formula

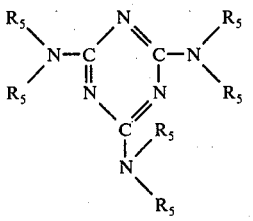

where $R_5$ at each occurrence is independently selected from the group consisting of hydrogen and $-CH_2OZ$ with Z being hydrogen or alkyl of 1 to 4 carbon atoms, provided that at least two of said $R_5$ groups are $-CH_2OZ$, and heating said fabric to coreact said ethoxylated compound and said melamine derivative.

2. A process as claimed in claim 1 wherein said aqueous composition additionally includes a urea-formaldehyde resin.

3. A process as claimed in claim 2 wherein said urea-formaldehyde resin is selected from the group consisting of dimethyloldihydroxyethyleneurea, dimethylolethyleneurea and urons.

4. A process as claimed in claim 1 wherein said aqueous composition contains an acid or acid forming salt which serves as a catalyst.

5. A process as claimed in claim 1 wherein said aqueous composition contains a nonionic surfactant.

6. A process as claimed in claim 1 wherein subsequent to the coreaction of said ethoxylated compound and said melamine derivative, said fabric is washed with an aqueous solution of an anionic surfactant.

7. A process of imparting durable antistatic properties to synthetic polymer fabric which comprises applying to said fabric an aqueous composition containing (A) an ethoxylated compound selected from the group consisting of compounds having the formula

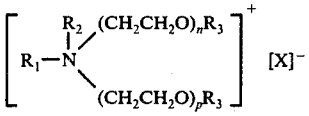

and

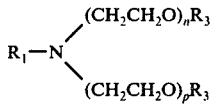

wherein $R_1$ is an alkyl group of 8 to 22 carbon atoms;

$R_2$ is an alkyl group of 1 to 22 carbon atoms or $-(CH_2CH_2O)_rR_4$;

$R_3$ is hydrogen, $-CH_2CH_2NH_2$ or $-CH_2CH_2SH$;

$R_4$ is hydrogen, $-CH_2CH_2NH_2$, $-CH_2CH_2SH$ or an alkyl group of 1 to 4 carbon atoms;

*n, p* and *r* are integers of from 5 to 60, and $X^-$ is an anion, and (B) A melamine derivative of the formula

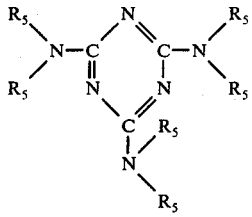

where $R_5$ at each occurrence is independently selected from the group consisting of hydrogen and $-CH_2OZ$ with Z being hydrogen or alkyl of 1 to 4 carbon atoms, provided that at least two of said $R_5$ groups are $-CH_2OZ$, and (C) a catalyst which is an acid or an acid forming salt, heating said fabric at a temperature of about 120° to 250° C. to form an insoluble product on said fabric by coreaction of said ethoxylated compound and said melamine derivative and washing said fabric with an aqueous solution of anionic surfactant.

8. A process as claimed in claim 7 wherein said aqueous composition additionally includes a urea-formaldehyde resin.

9. A process as claimed in claim 7 wherein said aqueous composition contains a nonionic surfactant.

10. A synthetic polymer fabric having deposited thereon a water insoluble antistatic composition comprising the reaction product of the melamine derivative and the ethoxylated compound of claim 1.

* * * * *